United States Patent [19]

Zimmerly

[11] 4,453,901

[45] Jun. 12, 1984

[54] POSITIVE DISPLACEMENT PUMP

[75] Inventor: Robert D. Zimmerly, Kenosha, Wis.

[73] Assignee: Ladish Co., Cudahy, Wis.

[21] Appl. No.: 470,034

[22] Filed: Feb. 28, 1983

[51] Int. Cl.[3] ..... F04C 2/00; F01C 1/24

[52] U.S. Cl. ..... 418/206

[58] Field of Search ..... 418/107–109, 418/205, 206; 411/237, 272

[56] References Cited

U.S. PATENT DOCUMENTS

| | | | |
|---|---|---|---|
| 1,116,095 | 11/1914 | Mellis | 411/237 |
| 1,457,455 | 6/1923 | Peters | 411/237 |
| 1,494,129 | 5/1924 | Ravier | 411/237 |
| 1,639,803 | 8/1927 | Jonsson | 411/237 |
| 1,717,789 | 6/1929 | Larrad | 411/237 |
| 2,449,846 | 9/1948 | Gilman | 411/237 |
| 3,494,399 | 2/1970 | Heighberger | 411/237 |
| 4,057,375 | 11/1977 | Nachtrieb | 418/206 |
| 4,290,736 | 9/1981 | Bernasconi | 418/206 |

FOREIGN PATENT DOCUMENTS

| | | | |
|---|---|---|---|
| 474888 | 10/1952 | Italy | 411/237 |
| 858138 | 1/1961 | United Kingdom | 411/237 |

*Primary Examiner*—Leonard E. Smith
*Assistant Examiner*—Jane E. Obee
*Attorney, Agent, or Firm*—Fuller, House & Hohenfeldt

[57] ABSTRACT

A sanitary positive displacement pump having increased internal clearances to allow increased operating pressures without detrimental wear while maintaining high volumetric efficiency. The invention includes rigid and accurate positioning of the liquid impellers to the shafts while maintaining ease of disassembly and assembly. The impellers are secured on the shafts by cooperating frusto-conical surfaces on each of a pair of nuts. A rubber retainer ring enables manual release of the nuts but prevents inadvertent spinoff.

15 Claims, 5 Drawing Figures

POSITIVE DISPLACEMENT PUMP

BACKGROUND OF THE INVENTION

1. Field of the Invention

This invention pertains to apparatus for pumping liquids, and more particularly to apparatus for positively pumping liquid and viscous liquid food products.

2. Description of the Prior Art

Positive displacement pumps for pumping liquid food products of various viscosities are well known. For example, catalog number PR73 published by the Ladish Co., Tri-Clover Division, Kenosha, Wis., describes positive displacement rotary pumps capable of pumping both high and low viscosity consumable liquids.

A primary requirement of the food processing industry is that all apparatus must meet rigid sanitation standards. U.S. Pat. No. 3,095,203 illustrates one design for sealing a liquid food product from possible sources of contamination within a pump. Sanitation requirements dictate, to a large extent, the design of food handling pumping equipment. Unlike pumps for handling non-edible liquids, as for example, hydraulic oil, sanitation pumps do not have bearings outboard of the pump impeller. Such bearings are not feasible because of inherent problems with lubrication, seal requirements and bearing materials. In addition, sanitary pump users demand pumps that are designed to be disassembled, cleaned and reassembled with a minimum of effort and down time. U.S. Pat. No. 3,227,088 discloses means for retaining the components of a pump as a unit during operation, but which allows quick and easy disassembly for cleaning.

The lack of outboard bearings on the impeller shaft makes shaft deflection a critical factor in the design and operation of sanitary pumps. As discharge pressures increase, the shaft deflection also increases. Discharge pressures in a typical well-known pump are limited to about 50 psig to 70 psig. Higher pressures result in reduced internal clearances to the point of interference between the rotors or impellers (hereinafter called impellers) and the pump housing. The consequence is that the tips of the impellers wear, which increases clearance with the housing, reduces pump efficiency and increases noise and vibration. Also, the abraded particles may be a source of contamination to the food product.

A related wear problem is involved in the mounting of the pump impeller to the impeller shaft. For ease of assembly and disasssembly, the impeller typically is driven by and is located on splines machined into the shaft. Due to normal manufacturing tolerances, a splined impeller inherently possesses a certain amount of looseness with respect to the shaft. The looseness is detrimental in that the impeller may cock slightly on the shaft splines, causing the impeller lobe tips to contact the housing, resulting in wear.

In sanitation pumps, problems arise in axially securing the impeller to the impeller shaft because of two conflicting requirements. On the one hand, it is necessary to firmly secure the impeller to the shaft. On the other hand, the impeller must be quickly and easily removable from the shaft for cleaning. One common design is to thread a single lock nut onto the shaft and against the impeller. This design has not proven completely satisfactory. Pumps are reversible, and the nut has a tendency to loosen and even fall off the end of the shaft. To prevent the loosened nut from damaging the shaft and pump, a clearance space large enough to hold the nut must be provided around the end of the shaft. A jam nut in conjunction with a lock nut, although somewhat superior to the single nut concept, has also proven unsatisfactory, primarily because of the reversible nature of the pump. In fact, the two nut design requires a clearance space twice as large as with a single nut. If this space is not present to afford spinoff, the loosened nuts can wedge in the cover and cause considerable damage to the pump. Another problem is that workmen cleaning the pump tend to place the nuts on their faces on any convenient surface. The result is that the faces, which must be flat and smooth to mate properly, become nicked. Consequently, the holding force between two abutting nuts diminishes to the point of eventual ineffectiveness. Polishing the nicked faces is not feasible because of the difficulty of maintaining perpendicularity between the nut axis and the nut faces.

Accordingly, a need exists for a food processing pump that can be operated at high pressures without wear caused by pump deflection and that includes components that consistently lock securely together but that can be quickly and easily disassembled.

SUMMARY OF THE INVENTION

In accordance with the present invention, a positive displacement pump is provided which is capable of operating at high pressures without detrimental wear caused by impeller deflection. This is accomplished by apparatus which includes a pair of meshing lobed impellers which are eccentrically located within the cavity of an impeller housing with respect to the pumping cavity walls. The pumping cavity is defined in part by a center section comprising spaced-apart generally parallel side walls. The center section is bounded on each end by an end section defined by a semi-circular wall which merges into the side walls. The difference in radius of each end section wall with respect to the radius of the impeller is larger than this difference in prior art pumps. However, the center of rotation of each impeller is displaced or offset with respect to the center of the semi-circular end wall toward the respective end wall by an amount equal to the increase in the end wall radius. As a result, the radial clearance between the impeller and the wall varies along the wall but is the same as prior art pumps in the critical leakage area which effects pump efficiency. Preferably, the clearance is greatest in the region where the side walls merge into the semi-circular end walls adjacent the pump inlet and outlet, and the clearance is least at the mid-point of the semi-circular end wall where a longitudinal center line intersects the end walls.

In operation, fluid discharge pressure deflects the impeller shaft toward a merger region between the side wall and a curved end wall. Because of the increased clearance in the merger region, higher operating pressures are possible before contact occurs between the impeller and the walls. At the same time, the radial clearance between the impeller and the mid point of the semi-circular end wall is equal to the radial clearance of prior pumps, thus maintaining high volumetric efficiency.

The present invention is also concerned with rigid and accurate positioning of the impeller in the pumping cavity to prevent interference with the pumping cavity semi-circular end walls. For that purpose, a rotor ring is interposed between an outer surface of the shaft and an associated inner surface of the impeller. The mating or interfitting surfaces of the rotor ring, shaft and impeller are machined so as to accurately locate the impeller relative to the shaft but still allow quick assembly and disassembly.

Further in accordance with the present invention, there is provided an improved means for retaining the impeller on the impeller shaft. In the preferred construction, the retaining means comprises a pair of cooperating rotor nuts threaded onto the impeller shaft. The nuts are formed with mating frusto-conical surfaces. The rotor nuts are threaded onto the impeller shaft and are tightened against the rotor ring and against each other. The conical surfaces cooperate to securely lock the impeller onto the shaft. A retainer is provided to retain the rotor nuts on the impeller shaft and prevent spinoff. Preferably, the retainer comprises an annular ring of readily deformable material which is seated in a shaft groove and encircles the threaded end outboard of the rotor nuts. To prevent the nuts from completely unthreading from the shaft, except by manual manipulation, the outer diameter of the safety ring protrudes beyond the minor diameter of the shaft threads. These features reduce the clearance needed for nut spin-off and hence reduce the size of the pump.

Other objects and advantages of the invention will become apparent from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
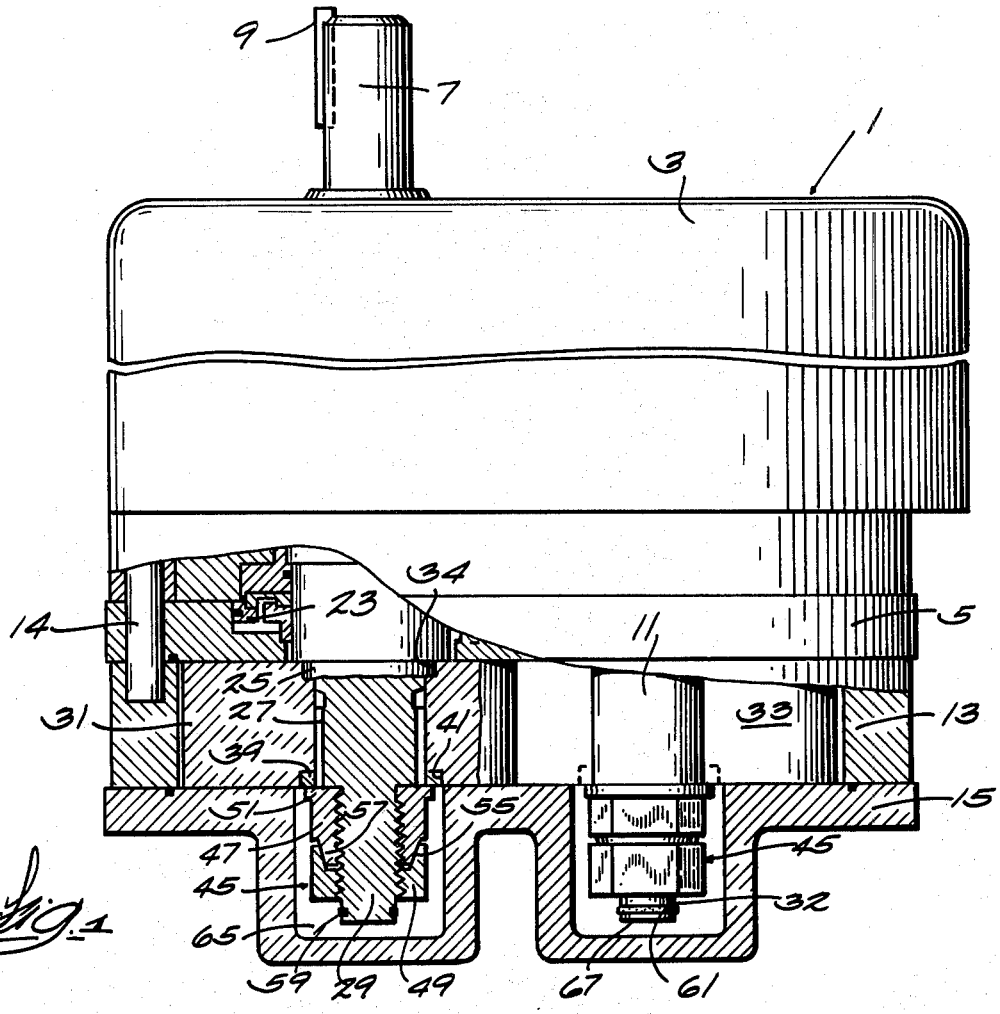
FIG. 1 is a side view, partially in section, of a sanitary positive displacement pump incorporating the present invention.

Referring to FIG. 1, a rotary positive displacement pump 1 is illustrated which includes the present invention. The pump finds particular usefulness in handling liquid and viscous liquid food products. However, it will be understood that the invention is not limited to sanitary applications. The pump includes a main housing 3 to which is detachably fastened an inner plate 5 by fastening means, not shown. The main housing supports a drive shaft 7, which is typically connected to a drive motor with a coupling and a key 9. The drive shaft is suitably mounted for rotation in the main housing by means of conventional bearings, not illustrated herein. A driven shaft 11 is mounted for rotation in suitable bearings, not shown, in the main housing parallel to the drive shaft. The bearings constrain both shafts against axial movement. A pair of meshing gears of standard construction, not shown, is employed to drive the driven shaft in the opposite direction as the drive shaft.

Detachably mounted by means not shown to the inner plate 5 is an impeller housing 13 and an outer plate or cover 15. The inner plate 5 and impeller housing 13 may be accurately located with respect to the main housing by locating pins 14. The inner plate, impeller housing and outer plate define a cavity 17 (FIG. 2) which is the liquid handling portion of the pump. The cavity is shaped as a generally rectangular center 19 bounded on each end by semi-circular end sections 21. The internal walls 22 of the center section are generally parallel and merge into the curved walls 24 of the end sections in regions 26. The impeller housing is formed on its opposite sides with fluid ports 18 and 20. To seal the cavity from the interior components of the pump, such as the bearings and gears, conventional sealing members 23 are employed around the drive shaft 7 and driven shaft 11. Only the seals on the drive shaft are shown in FIG. 1.

The portion of the drive shaft 7 (FIG. 1) which extends into the cavity 17, and thus is in contact with the liquid being pumped, includes a hub 25, a splined portion 27 and a threaded end 29. The driven shaft 11 is similar to the drive shaft in that it includes a hub, not shown, a splined portion 30 (FIG. 2) and a threaded end 32. Preferably, the threads on ends 29, 32 are acme threads.

To propel the fluid through the impeller cavity of the pump, a pair of meshing impellers 31, 33 are mounted on the splined portions of the drive shaft 7 and driven shaft 11, respectively. Although the pump may be bi-directional, it will be assumed for the present purposes that the direction of rotation of the impellers is shown by arrows 35, 37. In that case, fluid port 18 is the inlet port and fluid port 20 is the outlet port.

Figure 2:
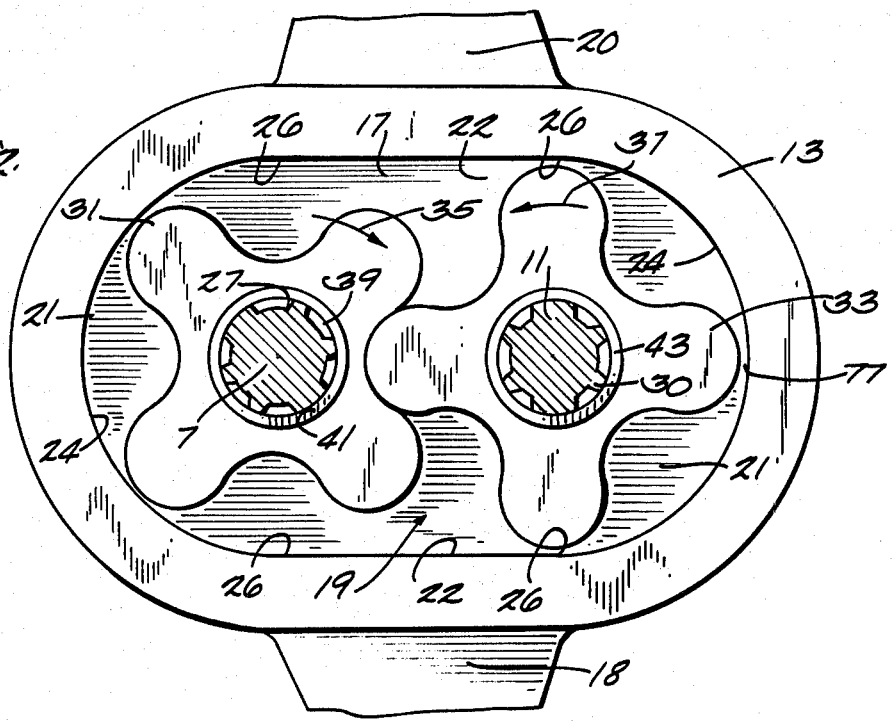
FIG. 2 is a sectional view taken along lines 2—2 of FIG. 1.

To accurately and rigidly and positively position the inboard end of impeller 31 on the drive shaft 7, the impeller is formed with a counter-bore having an internal circular surface 34. The surface 34 is machined to closely mate with the outer diameter of hub 25. To accurately and rigidly position the outboard end of impeller 31 on the drive shaft 7, a rotor ring 39 is interposed between and interfits with the outer diameter of the spline 27 and internal circular surface 41 of an associated counterbore in the impeller. The spline outer surface, rotor ring and counter-bore are machined so that the impeller is more rigidly and accurately positioned on the spline than is possible with a conventional splined connection which typically has considerable radial play. Nevertheless, the impeller may be easily disassembled from the spline. In a similar fashion, impeller 33 is mounted to the driven shaft by a hub, not shown, similar to hub 25 and by a rotor ring 43 (FIG. 2).

Figure 3:
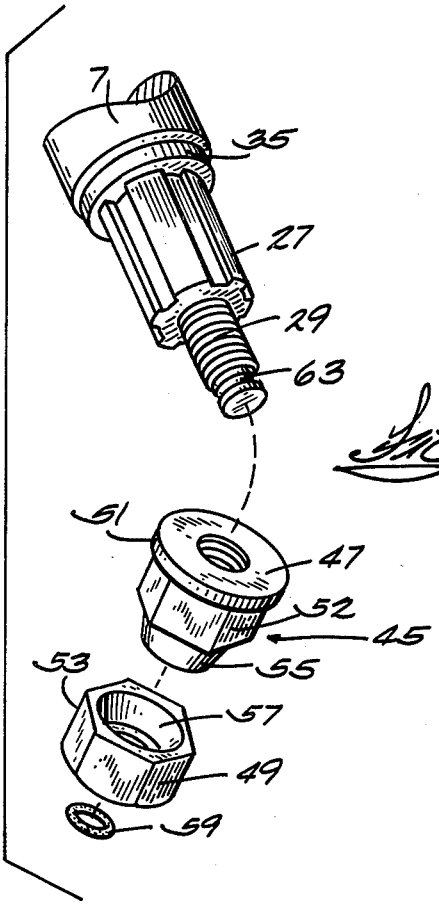
FIG. 3 is an exploded perspective view of the threaded end of the drive shaft showing the rotor nuts and retainer of this invention.

The invention also provides improved locking rotor nuts 45 to secure each impeller 31, 33 to the shafts 7, 11 (FIGS. 1 and 3). Each pair of rotor nuts 45 comprises a male nut 47 and a cooperating female nut 49. In the preferred construction, the male nut 47 is interposed between an impeller and the female nut 49. However, it will be recognized that the nut 47 could be the female nut 49 and not the male nut. Each male nut 47 preferably includes a flange 51 of a sufficient diameter to provide adequate bearing contact with the rotor rings 39, 43. To facilitate tightening and loosening the nuts, both the male and female nuts may be fabricated with hexagonal outer surfaces 52, 53, respectively (Fig. 3). Following the preferred design, the male nut is formed with an external frusto-conical surface 55 and the female nut is formed with a corresponding internal tapered or conical surface 57. Both the male and female nuts are threaded to fit the acme threaded ends 29, 32. The conical surfaces of both nuts are highly polished. To secure an impeller to a shaft, the male nut 47 is first tightly turned against the impeller. The female nut 49 is then tightly turned against the male nut so that the conical surfaces mate. As a result, the impeller is more securely locked to the shaft than was previously possible, but ease of disassembly is maintained. Further, the conical surfaces are less likely to become damaged through careless handling than in previous designs wherein the locking surfaces were flat faces on which the nuts were commonly placed during cleaning. It has been found that the angle between the nut axis and the conical surfaces is quite critical. For example, an angle of 10 degrees does not satisfactorily lock the impeller to the shaft, whereas an angle of 15 degrees provides excellent locking force. The 10 degree angle is a self-locking taper, and one taper locks against the other before it can jam on the thread. The locked tapers also create a single unit that has to be removed from the shaft for separation.

To ensure that the rotor nuts 45 do not unscrew from the threaded ends 29, 32 should they ever loosen, the present invention includes safety stops or retainers 59, 61 on each threaded end outboard of the rotor nuts. In the preferred embodiment, each safety stop consists of a circular O-ring of readily deformable material such as rubber or neoprene. The O-ring is positioned in the threaded end by means of a groove, such as at 63 in FIG. 3. The groove, O-ring and acme threads are proportioned such that the outer diameter of the O-ring projects above the minor diameter of the acme threads. Thus the rotor nuts may be manually threaded over the O-ring but the O-ring will prevent the nuts, should they ever loosen, from spinning off the ends of the shafts. As a result, the clearance spaces 65, 67 between the ends of the shafts 7, 11, respectively, and the outer plate or cover 15 is kept to a minimum. This is in contrast to prior constructions wherein spaces large enough to afford complete spin-off of one or more loosened nuts was necessary to prevent wedging of the nuts with the cover 15.

Figure 5:
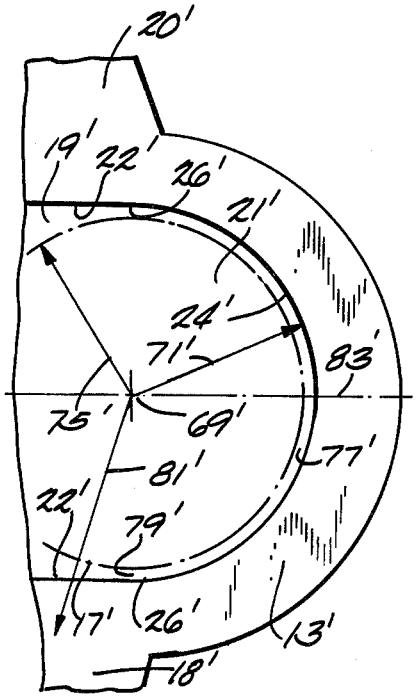
Fig. 5 PRIOR ART
FIG. 5 is a partial schematic drawing similar to FIG. 4 but showing the relationship between an impeller shaft and the impeller cavity internal walls of prior art pumps.

In accordance with the present invention, the impellers 31, 33 are eccentrically located within the impeller housing 13 so as to allow high pressure operation with minimum wear. This is accomplished in the present instance by increasing, with respect to the radius in prior pumps, the radius of each curved end wall 24 relative to the radius of the impellers and by locating the axes of rotation of the shafts 7, 11 eccentric to the centers of the walls 24. It is believed that the invention will be most readily understood by comparing the present pump with a prior art pump. Referring to FIG. 5, reference numeral 13' represents the impeller housing of prior pumps. Reference numberal 19' represents the center section of cavity 17'. The center section is defined by side walls 22'. Reference numeral 21' represents an end section of cavity 17'. End section 21' is defined by semi-circular internal wall 24'. Wall 24' merges with walls 22' at merger region 26'. Reference numeral 69' represents the center of the wall 24', and reference numberal 71' represents the radius of the wall 24'. Reference numeral 75 represents the radius of the impeller. The impeller center of rotation in previous pumps coincided with the center 69' of the wall 24'. A constant clearance 77' existed between the impeller and the wall 24'. The clearance is shown greatly exaggerated for clarity. The clearance 77' was chosen for minimum internal leakage and thus high volumetric efficiency consistent with practical machining capabilities. It will be noted that the clearance 79' between the impeller end wall at the merger region 26' is the same as clearance 77' at mid point 83' of the wall 24'. Reference numeral 81' represents the approximate direction of impeller shaft deflection due to the fluid pressure at discharge port 20'.

Figure 4:
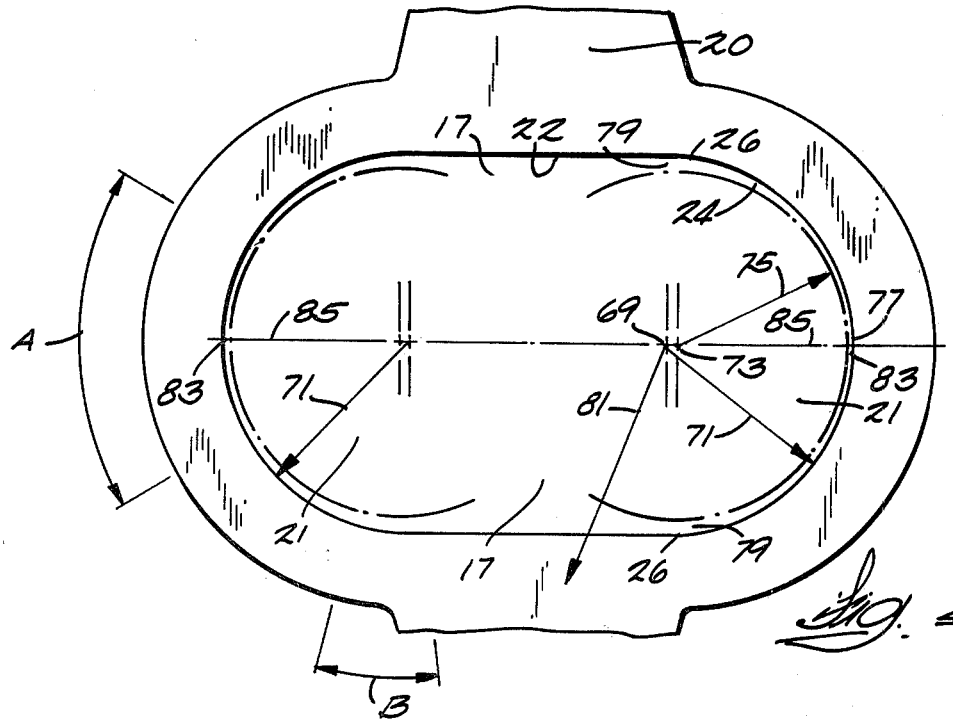
FIG. 4 is a partially schematic drawing of the impeller housing of the present invention showing the relationship between the impeller shafts and the internal walls of the impeller cavity.

Referring to FIG. 4, the construction of the preferred embodiment of the present invention will now be explained. Reference numeral 69 represents the center of the end section curved inner wall 24. Reference numeral 71 represents the radius of the wall 24, and that radius is larger than the radius 71' of prior art pumps. Reference numeral 75 represents the radius of the impeller, and that radius is the same as in previous pumps. Reference numeral 73 represents the center of rotation of the impeller. It will be noticed that the center 73 is displaced with respect to the center 69 in the direction toward the wall 24 and on the longitudinal center line 85. In the preferred construction, the amount of eccentricity between impeller axis 73 and the wall center 69 is equal to the increase in wall radius 71 over the prior art radius 71'. In that case, the clearance 77 in the pump of the invention at midpoint 83 and the centerline 85 intersects the wall 24 and is equal to the constant clearance 77', 79' of prior pumps. However, it will be noticed that the clearance 79 at the merger regions 26 is increased with respect to clearance 79' at the merger regions 26' of the prior pumps.

The advantage of this invention will now be explained. Referring to FIG. 4, angle A represents the critical leakage area that effects pump efficiency. This angle extends through approximately 34 degrees on either side of the end section midpoint 83. For optimum pump performance, the clearance 77 should be a minimum without contact between the impeller and cavity wall, and it should not change during pump operation. If the clearance 77 increases due to rotor wear or other reasons, the pump volumetric efficiency will decrease. Angle B represents the critical clearance area that is effected by impeller wear, which in turn affects pump life. This angle extends about 23 degrees along wall 24 and about 10 degrees along side wall 22 from merger region 26. Reference numerals 81 and 81' indicate the approximate direction of the deflection of the impeller shaft during operation (FIGS. 4 and 5). The deflections are produced by the high pressure of the liquid as it is discharged toward and out of outlet port 20. As the discharge pressure increases, the deflections along lines 81, 81' increase. In previous pumps, the deflection of the shaft, and thus the discharge liquid pressure, was limited by the clearance at 79' in the merger region 26'. If the deflection was too great, the impeller contacted the wall 24' and wear, noise and vibration could result.

By fabricating the walls 24 with increased radii 71 and by locating the impeller's axes of rotation eccentric to the centers of the walls 24, as taught by the present invention, the clearance 79 in the critical wear area is increased relative to prior designs. As a result, the useful operating pressure may be increased to approximately 120–150 psi for a pump which with the prior art design had working pressures of 50 to 70 psi, while providing longer life, lower maintenance and quieter operation than had previously been possible. At the same time, the minimum clearance 77 in the critical leakage area remains virtually unchanged and thus preserves the characteristics necessary for an efficient pump. In the preferred construction, the eccentricity between centers 69 and 73 may be on the order of about 0.005 inches. The clearance 77 may be about 0.004 inches. The clearance 79, with the shaft in the undeflected condition, may be about 0.009 inches.

Thus it is apparent that there has been provided, in accordance with the invention, a positive displacement pump that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A positive displacement pump having walls defining the generally oval pumping chamber with circular end walls merging with intermediate walls generally parallel to a longitudinal center line, and inlet and outlet passages communicating with the pumping chamber, a pair of impellers operatively associated with said circular end walls to define a first clearance zone spanning on both sides of the intersection of the center line with said circular end walls with said first clearance selected to minimize leakage and a second clearance zone along said curved walls adjacent said parallel walls with a second clearance to minimize wear caused by deflection, and wherein said curved end walls have a first center and said impellers have a second center, said second center being offset toward said curved end walls on said longitudinal center line from the end wall center to eccentrically locate said impellers with respect to the curved end walls to maintain a second clearance larger than said first clearance to afford deflection under pressure without interference between the impellers and said walls in said second zone.

2. In a positive displacement pump for pumping liquids and viscous liquids, having a main housing; a drive shaft mounted for rotation in the main housing about a first axis; a driven shaft mounted for rotation in the main housing about a second axis; drive means for rotating the driven shaft in times relation to the drive shaft; an inner plate detachably fastened to the main housing; a pair of impellers having outer radii; means for mounting and driving the impellers in meshing contact on the drive and driven shafts for rotation therewith; means for securing the impellers to the respective shafts; and an outer plate detachably fastened to the main housing;

an improved impeller housing interposed between the inner and outer plates and forming a cavity therewith for receiving the impellers and liquid and having at least two fluid ports therein, said housing cavity being defined by (a) a pair of spaced apart center internal side walls and generally parallel to a longitudinal center line which extends through the housing center; and (b) first and second semi-circular internal end walls. each end wall having a midpoint at the intersection with the center line and merging with the center walls at a merger region to form a substantially continuous generally oval-shaped internal wall, the radii of the end walls being slightly larger than the outar radii of the impellers to provide a first clearance, the centers of the first and second end walls being offset relative to the first and second shaft axes of rotation, respectively, in the direction away from tne intersection of said center line and the first and second walls and toward the housing center so that there is a second clearance between the impellers and the semi-circular end walls which is greater in the merger region than at the midpoint of the end walls, said second clearance being greater than the first clearance to enable impeller deflection during use without interference with the housing walls at the merger, region 3. The positive displacement pump of claim 2 wherein the axes of rotation of the first and second shafts and the centers of the first and second semi-circular end walls intersect a straight line.

4. The positive displacement pump of claim 2 wherein the centers of the first and second semi-circular end walls are displaced relative to the first and second shaft axes of rotation, respectively, about 0.005 inches.

5. The positive displacement pump of claim 3 wherein the clearance between the impeller and the semi-circular end wall at the wall midpoint is about 0.004 inches, and wherein the clearance between the impeller and the end wall in the merger region with the side walls is about 0.009 inches.

6. The positive displacement pump of claim 2 wherein the drive and driven shafts are formed with threaded ends, and wherein the means for securing an impeller to a shaft comprises (a) first nut comprising:

(i) internal threads adapted to engage the shaft threaded end;

(ii) an abutment surface substantially perpendicular to the axis of rotation of the threads; and (iii) a frusto-conical surface having an axis parallel to the thread axis and located on the opposite side of the nut from the abutment surface; and (b) a second nut comprising:

(i) internal threads adapted to engage the shaft threaded end; and (ii) a frusto-conical surface adapted to mate with the frusto-conical surface of the first nut, so that tightening the first nut against the impeller and tightening the second nut against the first nut securely locks the impeller to the shaft.

7. The positive displacement pump of claim 6 wherein the frusto-conical surface of the first nut is an external surface, and wherein the frustoconical surface of the second nut is an internal surface.

8. The positive displacement pump of claim 6 wherein the threads on the threaded ends of the shafts are acme threads.

9. The positive displacement pump of claim 8 wherein the angle between the frusto-conical surfaces of the first and second nuts relative to the thread access of rotation is about 15 degrees.

10. The positive displacement pump of claim 6 wherein the threaded ends of the drive and driven shafts include nut safety stops located outboard of the first and second nuts.

11. The positive displacement pump of claim 10 wherein each nut safety stop comprises an annular ring of resilient material encircling the shaft threaded end.

12. The positive displacement pump of claim 11 wherein the outer diameter of the annular ring is greater than the inner diameter of the threads of the nut.

13. The positive displacement pump of claim 2 including the further improvement wherein the means for mounting and driving the impellers to the drive and driven shafts includes:

(a) an external splined portion integral with the shaft;

(b) an internal spline integral with the impeller for engagement with the shaft external splined portion, the internal spline being formed with a counterbore at the outboard end thereof; and (c) a rotor ring interposed between and interfitting with the external splined portion and the internal splined counter-bore.

14. The positive displacement pump of claim 13 wherein the drive and driven shafts are formed with acme threaded ends, and wherein the means for securing the impeller to a shaft comprises a pair of cooperating rotor nuts with interfitting surfaces adapted to be threaded onto the shaft threaded end into abutment with the rotor ring.

15. The positive displacement pump of claim 14 wherein the rotor nuts comprise (a) a first nut having a frusto-conical surface, the access of the frusto-conical surface being parallel to the thread access; and (b) a second nut having a frusto-conical surface for cooperating engagement with the frusto-conical surface of the first nut, so that engagement of the frusto-conical surfaces of the first and second nuts lock the two nuts to secure the impeller to the shaft.

* * * * *